US006186907B1

(12) United States Patent
Woodward

(10) Patent No.: US 6,186,907 B1
(45) Date of Patent: Feb. 13, 2001

(54) SELECTIVELY POSITIONABLE GOLF TEE

(76) Inventor: Jay Woodward, P.O. Box 361, Santa Fe Springs, CA (US) 90065

( * ) Notice: Under 35 U.S.C. 154(b), the term of this patent shall be extended for 0 days.

(21) Appl. No.: 09/323,218

(22) Filed: Jun. 1, 1999

Related U.S. Application Data

(60) Provisional application No. 60/088,732, filed on Jun. 10, 1998.

(51) Int. Cl.[7] ..... A63B 57/00
(52) U.S. Cl. ..... 473/400; 473/398
(58) Field of Search ..... 473/387–403; D21/717, 718

(56) References Cited

U.S. PATENT DOCUMENTS

D. 346,190 * 4/1994 Folker ..... D21/718
1,736,583 * 11/1929 Deike ..... 473/396
2,668,710 * 2/1954 Carlson ..... 473/393
4,893,818 * 1/1990 Liccardello ..... 473/396
5,372,362 * 12/1994 Barker ..... 473/391
5,571,044 * 11/1996 Lewis et al. ..... 473/398
5,672,122 * 9/1997 Strong ..... 473/398
5,720,677 * 2/1998 Rudduck ..... 473/387
5,759,119 * 6/1998 Ayoub ..... 473/398

* cited by examiner

*Primary Examiner*—Steven Wong
(74) *Attorney, Agent, or Firm*—Edward A. Sokolski

(57) ABSTRACT

A golf tee has a collar thereon which forms a stop when the tee is placed in the ground to set the top of the tee at a predetermined height above the ground. The collar position is set in separate tees for each golf club and for each golfer so that when the ball is placed on the tee, the head of the golf club will strike the ball at an optimum position, as may be desired. A modification of the basic device uses an extension piece which fits into the top of the tee so that the same tee can be adapted by using different length extension pieces to satisfy various height requirements. This extension piece has a tee seat for the ball on one end and a pin on the other end which fits into a hole formed in the ball seat of the tee.

3 Claims, 1 Drawing Sheet

SELECTIVELY POSITIONABLE GOLF TEE

This application claims benefit of Provisional application Ser. No. 60/088,732, filed Jun. 10, 1998.

BACKGROUND OF THE INVENTION

1. Field of the Invention

This invention relates to golf tees and more particularly to such a tee which is adapted for positioning in the ground with its ball seat a predetermined height above the ground.

2. Description of the Related Art

Golf tees are generally positioned in the ground with their ball seats at an arbitrary height above ground level. There generally is no positive device on the tee for fixing this position. For proper striking of the ball by the golf club head, there is an optimum height above ground level for each club and each golfer. While an expert golfer usually has learned how to set the height of the tee, this is difficult to do for the less experienced golfer. The device of the present invention solves this problem by providing a golf tee or set of golf tees which can readily be set in the ground with their ball seats at predetermined heights above the level of the ground.

SUMMARY OF THE INVENTION

The device of the present invention is an improvement over the prior art in that it provides a golf tee or set of golf tees which are adapted so they can readily be set in the ground with their ball seats at an optimum height above ground level for each golf club and golfer.

This improvement is achieved by providing a collar on the golf tee which forms a stop when the tee is placed in the ground to set the golf seat of the tee at a predetermined height above ground level. The position of the collar on each tee provided is set for optimum striking of the ball for each golf club and each golfer.

A modified version of the device of the invention achieves the desired end result using only a single tee with a set of extension pieces which enables positioning of the ball seat at various different heights above ground, as may be desired. The extension pieces have a tee seat for the ball on one end and a pin on the other end which fits into a hole in the ball seat of the tee.

It is therefore an object of this invention to provide an improved golf tee which is adapted to be set with its ball seat a predetermined height above ground.

It is a further object of this invention to provide a golf tee which facilitates the striking of a golf ball in an optimum manner.

Other objects of the invention will become apparent in view of the following description taken in connection with the accompanying drawings.

DETAILED DESCRIPTION OF THE INVENTION

Figure 1:
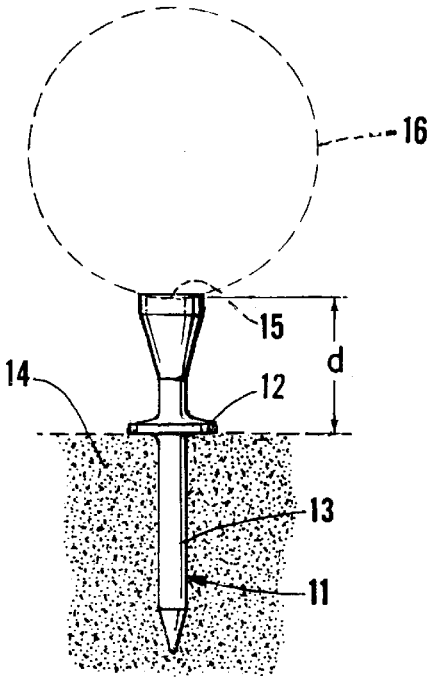
FIG. 1 is a side elevational view of a first embodiment of the invention shown installed in the ground with a golf ball thereon.
Figure 2:
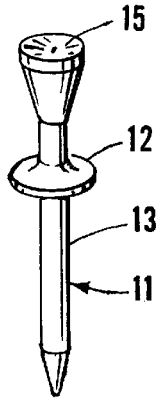
FIG. 2 is a top perspective view of the first embodiment.

Referring now to FIGS. 1 and 2, a first embodiment of the invention is shown.

Tee 11 has a main body portion 13 in the form of a post with a stationary collar 12 formed thereon. As shown in FIG. 1, when the tee is installed in the ground 14, collar 12 acts as a stop to set the vertical distance "d" of the ball seat 15 and the bottom of ball 16 placed on this seat from the ground. This distance is preset for a separate tee for each different type of golf club and for each player so that the head of the golf club will tend to strike the ball at an optimum spot, as may be desired.

Figure 3:
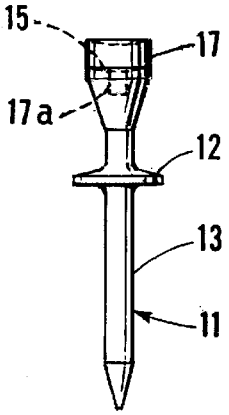
FIG. 3 is a side elevational view of a second embodiment of the invention.
Figure 4:
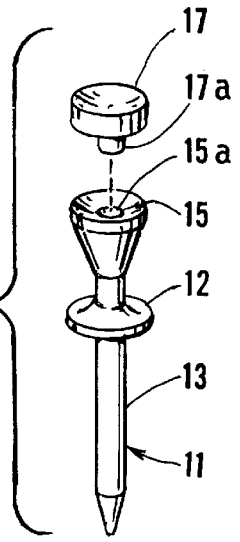
FIG. 4 is an exploded top perspective view of the second embodiment.

Referring now to FIGS. 3 and 4, a second embodiment of the invention is shown. As for the first embodiment, tee 11 has a stationary collar 12 formed therein which acts as a stop to establish an ideal ball height above ground for a particular golf club and a particular golfer. In the second embodiment, this distance can be changed using the same tee to provide different heights by installing different extension pieces 17 in ball seat 15.

Extension piece 17 has a pin portion 17*a* extending from its main body portion which fits into a mating hole 15*a* formed in seat 15. A series of extension pieces are employed, each having a different height to provide the desired effective tee height for each particular club and golfer, these extension pieces being installed in the alternative. Thus, in the second embodiment as single tee can be used with a set of extension pieces to handle different requirements.

While the invention has been described and illustrate in detail it is to be understand that this is intended by way of illustration and example only, the scope of the invention being limited by the terms of the following claims.

I claim:

1. A golf tee for supporting a golf ball at a predetermined height above the ground comprising:

a main body portion in the form of a post;

a collar portion formed on said main body portion and extending radially outwardly therefrom;

a top portion formed on the top of said main body portion, said top portion extending outwardly from said main body portion, said top portion having a top seat formed therein which is recessed to receive the golf ball;

a set of extension pieces, each having a different height and a top seat formed therein, wherein a top extension piece is selected from the set of extension pieces; and means for removably installing the selected top extension piece in the top seat of said top portion;

whereby when the collar portion is installed against the surface of the ground, said collar portion, and the top seat of the selected top extension piece are positioned from each other by a distance to locate the golf ball a predetermined height above the ground for optimum stroking of the ball.

2. The device of claim 1 wherein the main body portion is cylindrical in shape.

3. The device of claim 1 wherein said means for removably installing said extension piece in said top seat comprises a hole formed in said top seat and a pin formed in said extension piece, said pin being installed in said top seat.

* * * * *